US008443789B2

(12) United States Patent
Wu

(10) Patent No.: US 8,443,789 B2
(45) Date of Patent: May 21, 2013

(54) EXHAUST GAS RECIRCULATION SYSTEM FOR AN INTERNAL COMBUSTION ENGINE

(75) Inventor: Ko-Jen Wu, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 298 days.

(21) Appl. No.: 12/842,169

(22) Filed: Jul. 23, 2010

(65) Prior Publication Data

US 2012/0017879 A1 Jan. 26, 2012

(51) Int. Cl.
*F02B 47/08* (2006.01)
*F02B 47/00* (2006.01)

(52) U.S. Cl.
USPC ..... 123/568.12; 123/568.15

(58) Field of Classification Search
USPC ..... 123/568.12, 568.11, 568.15, 568.21, 123/542, 559.1; 701/108; 60/605.1, 605.2, 60/598, 599, 602
See application file for complete search history.

(56) References Cited

U.S. PATENT DOCUMENTS 7,261,086 B2 * 8/2007 Nuang ..... 123/436
7,444,804 B2 * 11/2008 Hashizume ..... 60/297
2007/0186536 A1 8/2007 Hashizume

OTHER PUBLICATIONS

Chinese Office Action for Application No. 201110206584.4 dated Feb. 27, 2013; 7 pages.

* cited by examiner

*Primary Examiner* — Mahmoud Gimie
(74) *Attorney, Agent, or Firm* — Cantor Colburn LLP

(57) ABSTRACT

An exhaust gas recirculation system for an internal combustion engine comprises an exhaust driven turbocharger having a low pressure turbine outlet in fluid communication with an exhaust gas conduit. The turbocharger also includes a low pressure compressor intake and a high pressure compressor outlet in communication with an intake air conduit. An exhaust gas recirculation conduit fluidly communicates with the exhaust gas conduit to divert a portion of exhaust gas to a low pressure exhaust gas recirculation branch extending between the exhaust gas recirculation conduit and an engine intake system for delivery of exhaust gas thereto. A high pressure exhaust gas recirculation branch extends between the exhaust gas recirculation conduit and the compressor intake and delivers exhaust gas to the compressor for mixing with a compressed intake charge for delivery to the intake system.

16 Claims, 3 Drawing Sheets

EXHAUST GAS RECIRCULATION SYSTEM FOR AN INTERNAL COMBUSTION ENGINE

GOVERNMENT RIGHTS

This invention was made with U.S. Government support under agreement number DE-FC26-07NT43271 awarded by the Department of Energy. The U.S. Government may have certain rights in this invention.

FIELD OF THE INVENTION

Exemplary embodiments of the present invention relate to an exhaust gas recirculation system for an internal combustion engine and, more particularly, to a system for efficiently providing both high pressure, compressed and low pressure, uncompressed recirculated exhaust gas to the intake system of an internal combustion engine.

BACKGROUND

Recirculated exhaust gas ("EGR") is becoming an important element for both diesel and gasoline engines, particularly engines utilizing charge air boosting or compression (ex. exhaust driven turbocharger or engine driven supercharger,) for both fuel consumption improvements and for the reduction of regulated tailpipe exhaust gas emissions.

In some engine applications two EGR supplies, one high pressure and one low pressure, are supplied to the engine based on the then current engine operating conditions. In engines utilizing an exhaust driven turbocharger, high pressure EGR is typically diverted from a location upstream of the turbocharger and is supplied to the compressed intake charge during high load operation while low pressure EGR is diverted from a location downstream of the turbocharger and is supplied to a location downstream of the throttle body during low load operation. Diverting EGR from a location upstream of the exhaust driven turbocharger may, however, compromise the performance of the turbocharger by limiting the exhaust gas, and resultant exhaust energy available thereto.

SUMMARY OF THE INVENTION

In an exemplary embodiment an exhaust gas recirculation system in fluid communication with an intake system of an internal combustion engine comprises an exhaust system having an exhaust manifold in fluid communication with cylinders of the engine and configured to remove exhaust therefrom, an exhaust gas driven turbocharger having a turbine housing including a high pressure turbine inlet in fluid communication with the exhaust manifold and configured to receive exhaust gas therefrom, a low pressure turbine outlet in fluid communication with an exhaust gas conduit of the exhaust system for discharge of exhaust gas from the turbine housing and a compressor housing having a low pressure compressor inlet in communication with ambient and a high pressure compressor outlet in communication with the intake system. An exhaust gas recirculation conduit is in fluid communication with the exhaust gas conduit and is configured to divert a portion of exhaust gas from the conduit. A low pressure exhaust gas recirculation branch extends between and fluidly connects the exhaust gas recirculation conduit and the intake system to deliver uncompressed exhaust gas thereto and a high pressure exhaust gas recirculation branch extends between and fluidly connects the exhaust gas recirculation conduit and the low pressure compressor inlet of the exhaust gas driven turbocharger to deliver exhaust gas to the compressor for compression therein and delivery to the intake system.

In another exemplary embodiment, an internal combustion engine comprises an intake system having an intake manifold in fluid communication with cylinders of the engine and configured to deliver an intake charge thereto, a throttle in fluid communication with the intake manifold and configured to receive the intake air charge from an intake air conduit for delivery to the intake manifold, an exhaust system having exhaust manifold in fluid communication with the cylinders of the engine and configured to remove exhaust gas therefrom and an exhaust gas driven turbocharger including a high pressure turbine inlet in fluid communication with the exhaust manifold, a low pressure turbine outlet in fluid communication with an exhaust gas conduit of the exhaust system and a compressor housing including a low pressure compressor inlet in communication with ambient and a high pressure compressor outlet in communication with the intake air conduit. An exhaust gas recirculation conduit is in fluid communication with the exhaust gas conduit. A low pressure exhaust gas recirculation branch extends between the exhaust gas recirculation conduit and the intake system at a position downstream of the throttle and a high pressure exhaust gas recirculation branch extends between the exhaust gas recirculation conduit and the low pressure compressor inlet of the exhaust gas driven turbocharger.

The above features and advantages, and other features and advantages of the present invention are readily apparent from the following detailed description of the invention when taken in connection with the accompanying drawings.

BRIEF DESCRIPTION OF THE DRAWINGS

Other features, advantages and details appear, by way of example only, in the following detailed description of the embodiments, the detailed description referring to the drawings in which.

DESCRIPTION OF THE EMBODIMENTS

Figure 1:
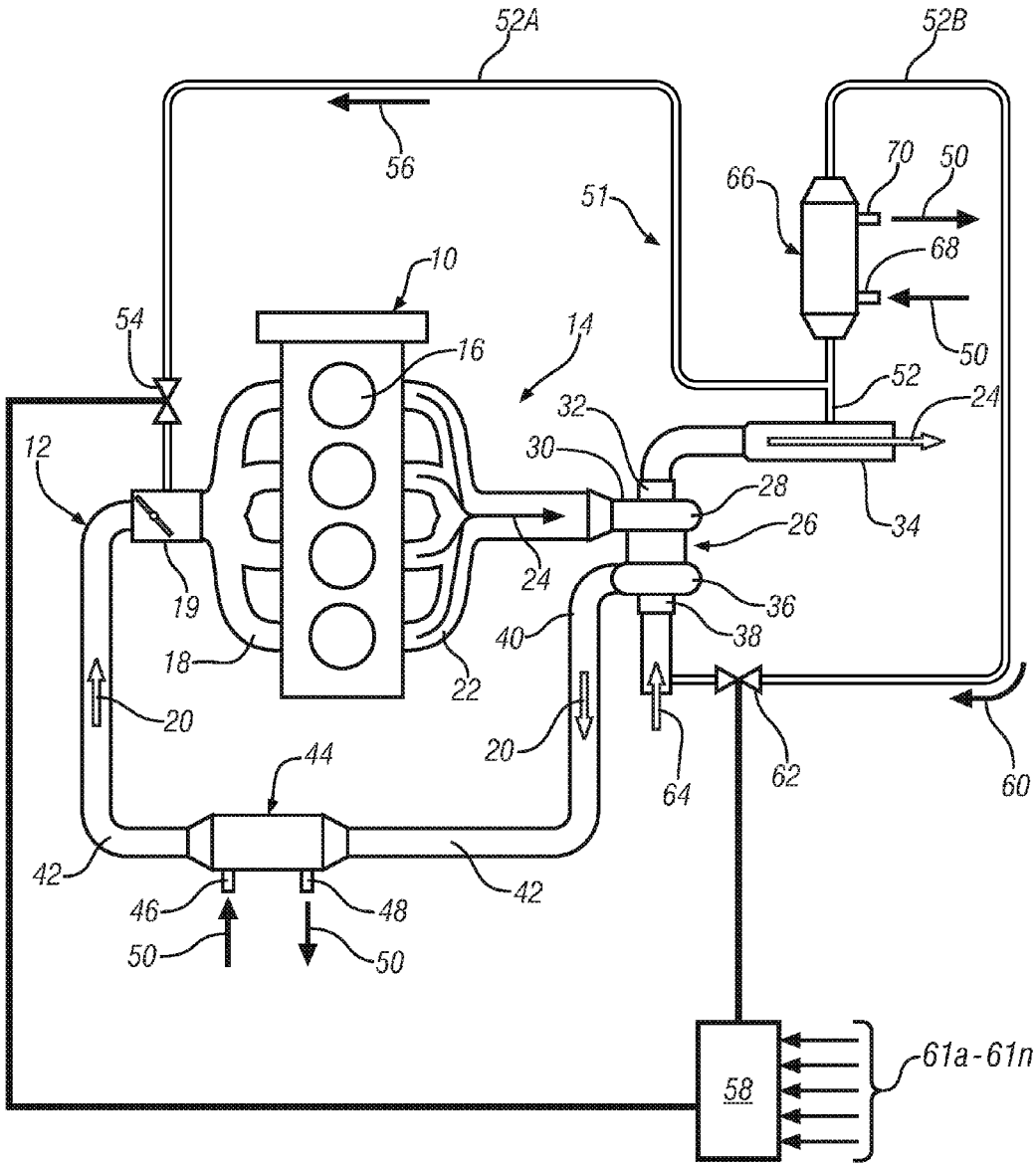
FIG. 1 is a schematic view of an internal combustion engine system comprising an exhaust gas recirculation system and an intake charge system embodying features of the present invention.

The following description is merely exemplary in nature and is not intended to limit the present disclosure, application or uses. It should be understood that throughout the drawings, corresponding reference numerals indicate like or corresponding parts and features.

Referring to FIG. 1, an exemplary embodiment is directed to an internal combustion engine 10, in this case an in-line 4 cylinder engine, including an intake system 12 and an exhaust system 14. The internal combustion engine includes a plurality of cylinders 16 into which a combination of an intake charge and fuel are introduced. The intake charge/fuel mixture is combusted in the cylinders 16 resulting in reciprocation of pistons (not shown) therein. The reciprocation of the pistons rotates a crankshaft (not shown) to deliver motive power to a vehicle powertrain (not shown) or to a generator or other stationary recipient of such power (not shown) in the case of a stationary application of the internal combustion engine 10.

The internal combustion engine 10 includes an intake manifold 18, in fluid communication with the cylinders 16 that receives a compressed intake charge 20 from the intake system 12 through a throttle body 19 and delivers the charge to the plurality of cylinders 16. The exhaust system 14 includes an exhaust manifold 22, also in fluid communication with the cylinders 16, which is configured to remove the combusted constituents of the intake charge/fuel mixture (i.e. exhaust gas 24) and to deliver it to an exhaust driven turbocharger 26 that is located in fluid communication therewith. The exhaust driven turbocharger 26 includes an exhaust gas turbine (not shown) that is housed within a turbine housing 28. The turbine housing 28 includes a turbine housing inlet 30 and a turbine housing outlet 32. The low pressure outlet 32 is in fluid communication with the remainder of the exhaust system 14 and delivers the exhaust gas 24 to an exhaust gas conduit 34 which may include various exhaust after treatment devices (not shown) that are configured to treat various regulated constituents of the exhaust gas 24 prior to its release to the atmosphere.

The exhaust driven turbocharger 26 also includes a combustion charge compressor wheel (not shown) that is housed within a compressor housing 36. The compressor housing 36 includes a low pressure inlet 38 that is typically in fluid communication with ambient air 64 and a high pressure outlet 40. The high pressure outlet 40 is in fluid communication with the intake system 12 and delivers a compressed intake charge 20 through an intake charge conduit 42 to the intake manifold 18 for delivery to the cylinders 16 of the internal combustion engine 10. In an exemplary embodiment, disposed inline in intake charge conduit 42, between the outlet 40 of the compressor housing 36 and the intake manifold 18, is an intake charge cooler 44. The intake charge cooler 44 receives heated (due to compression) compressed intake charge 20 from the intake charge conduit 42 and, following cooling of the compressed intake charge 20 therein, delivers it to the intake manifold 18 through a subsequent portion of the intake charge conduit 42. The intake charge cooler 44 comprises an inlet 46 and an outlet 48 for the circulation of a cooling medium 50 (such as a typical glycol-based automotive coolant) therethrough. In a known manner, the intake charge cooler 44 transfers heat from the compressed intake charge 20 to the cooling medium 50 to thereby reduce the temperature of the compressed intake charge 20 as it transits the intake charge cooler 44. The intake charge cooler inlet 46 receives the low temperature coolant medium 50 from a cooling system (not shown). The cooling system may comprise a branch of the cooling system of the internal combustion engine 10 or may comprise a separate, stand-alone, low temperature cooling system for increased heat transfer efficiency due to a higher temperature differential between the cooling medium 50 and the compressed intake charge 20.

Located in fluid communication with the exhaust system 14, and in the exemplary embodiment shown in FIG. 1, is an exhaust gas recirculation ("EGR") system 51, including an EGR conduit 52 that is in fluid communication with the exhaust gas conduit 34 for diversion of exhaust gas 24 therefrom. The EGR conduit 52 is located on the downstream, low pressure side of the exhaust driven turbocharger 26, and is configured to divert a portion of the exhaust gas 24 from the exhaust gas conduit 34 and to return it to, or recirculate it to, the intake system 12 as will be further described herein. In the embodiment shown in FIG. 1, the EGR conduit 52 includes two branches, a low pressure branch 52A and a high pressure branch 52B. Low pressure branch 52A extends between and fluidly connects the EGR conduit 52 and the intake system 12 where it is, in an exemplary embodiment, fluidly connected downstream of the throttle 19. A first exhaust gas recirculation ("EGR") valve 54 is fluidly connected to the low pressure branch 52A and is configured to control the flow of diverted exhaust gas 56 therethrough and to the intake system 12 of the internal combustion engine 10. The first EGR valve 54 is in signal communication with a control module such as engine controller 58 that is configured to operate the first EGR valve 54 to vary the volumetric quantity of diverted exhaust gas 56 flowing therethrough and introduced to the intake system 12, based on the particular engine operating conditions at any given time. The engine controller 58 collects information regarding the operation of the internal combustion engine 10 from sensors 61*a*-61*n*, such as the temperature of the exhaust system, engine coolant, compressed combustion charge, ambient, etc., as well as pressure, exhaust system conditions and driver demand to determine the appropriate, if any, flow of exhaust gas 56 to be recirculated to the intake system 12 of the internal combustion engine 10 through the EGR conduit low pressure branch 52A.

In an exemplary embodiment, high pressure EGR branch 52B extends between the EGR conduit 52 and the compressor housing inlet 38 of the exhaust driven turbocharger 26 to which it is fluidly connected for delivery of diverted exhaust gas 60 thereto. A second exhaust gas recirculation ("EGR") valve 62 is fluidly connected to the EGR conduit high pressure branch 52B and is configured to control the flow of diverted exhaust gas 60 therethrough and to the compressor housing inlet 38 of the exhaust driven turbocharger 26 for compression therein. The second EGR valve 62 is also in signal communication with control module 58 and is configured to operate the second EGR valve 62 to vary the volumetric quantity of diverted exhaust gas 60 flowing therethrough and introduced to the intake system 12, through the compressor housing 36 of the exhaust driven turbocharger 26. This results in a compressed intake charge 20 that comprises a combination of compressed ambient air 64 and compressed diverted exhaust gas 60, for recirculation to the intake system 12. As described herein, the engine controller 58 collects information regarding the operation of the internal combustion engine 10 and determines the appropriate, if any, flow of diverted exhaust gas 60 to be delivered to the compressor housing inlet 38 by the EGR valve 62 for addition to the compressed intake charge 20 and subsequent delivery to the intake system 12 of the internal combustion engine 10 through the throttle body 19.

Typically, diverted exhaust gas 60 is added to the compressed intake charge 20 under high load operations when the pressure of the compressed intake charge 20 is high. The operation of the high pressure branch is determined by the pressure differential which drives the flow. During such operation, the pressure downstream of the throttle 19 is as low as about 70 kPa absolute. For lower loads, the pressure differential would become too low for the high pressure branch to provide sufficient EGR flow. These are the conditions under which the low pressure branch has an advantage.

Such a pressure differential may result in the backflow of the compressed intake charge 20 into the low pressure branch 52A of the EGR conduit 52 preventing the delivery of EGR to the intake system 12. The present invention provides for the supply of low pressure, uncompressed or high pressure, compressed diverted exhaust gas 56, 60 respectively, to the intake system 12 of the internal combustion engine 10 without the need to divert high pressure exhaust gas 24 from a location that is upstream of the exhaust driven turbocharger 26. As a result, the full energy of the exhaust gas 24 is preserved for use by the exhaust driven turbocharger 26 and, therefore, the performance of the turbocharger 26 is improved to the benefit of the operation of the engine 10.

In an exemplary embodiment, disposed inline of the high pressure branch of the EGR conduit 52B, is an exhaust gas cooler 66. The exhaust gas cooler 66 receives diverted exhaust gas 60 from the EGR conduit 52 and, following cooling of the diverted exhaust gas 60 therein, delivers the cooled, exhaust gas through the high pressure branch of the EGR conduit 52B to the compressor housing inlet 38. The exhaust gas cooler 66 comprises an inlet 68 and an outlet 70 for the circulation of cooling medium 50 therethrough. In a known manner, the exhaust gas cooler 66 transfers heat from the diverted exhaust gas 60 to the cooling medium 50 to thereby reduce the temperature of the diverted exhaust gas 60 prior to its introduction to the compressor housing inlet 38 of the exhaust driven turbocharger 26.

The use of intake charge cooler 44 and exhaust gas cooler 66 results in a significant increase in the capacity to cool the compressed intake charge 20 and the diverted exhaust gas 60 prior to their introduction into the intake system 12 of the internal combustion engine 10. Such cooling of the compressed intake charge 20 helps to increase the density of the charge which boosts the power efficiency of the engine 10. Adding larger and cooler quantities of exhaust gas to the intake system 12 reduces the temperature of the combustion event, helps extract more work from the engine 10 and results in less waste heat/energy that must be removed by the engine cooling system. Alternately, under low-load operation of the internal combustion engine 10, delivery of un-cooled diverted exhaust gas 56 is desirable as a higher intake charge temperature will promote efficient combustion under cooler operating conditions of the engine 10. In addition, the transient response of the recirculated exhaust gas 56 supply to changes in engine requirements for recirculated exhaust gas are improved due to the direct connection of the EGR conduit low pressure branch 52A to the intake manifold 18.

Figure 2:
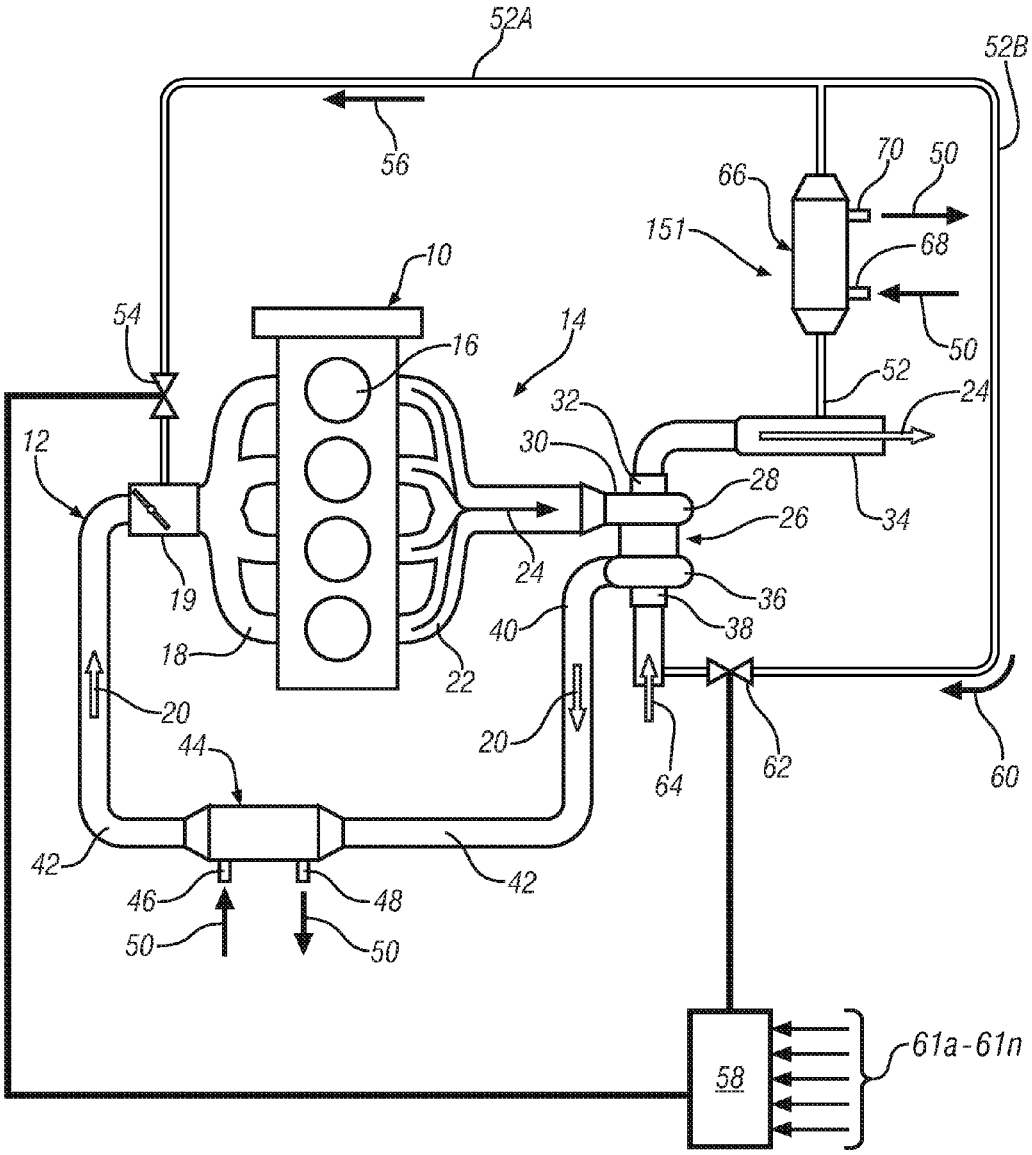
FIG. 2 is a schematic view of an internal combustion engine system comprising another embodiment of the exhaust gas recirculation system and the intake air charge system of FIG. 1, embodying features of the present invention.

Referring now to FIG. 2, in another exemplary embodiment, in which like reference numerals refer to like features already described, the exhaust gas recirculation ("EGR") system 151 includes an EGR conduit 52 in fluid communication with the exhaust gas conduit 34 for diversion of exhaust gas 24 therefrom. The EGR conduit 52 is located on the downstream, low pressure side of the exhaust driven turbocharger 26, and is configured to divert a portion of the exhaust gas 24 from the exhaust gas conduit 34 and to return it to, or recirculate it to, the intake system 12. Disposed inline of the EGR conduit 52, is an exhaust gas cooler 66 comprising an inlet 68 and an outlet 70 for the circulation of cooling medium 50 therethrough. The exhaust gas cooler 66 receives exhaust gas 24 from the EGR conduit 52 and, following cooling of the diverted exhaust gas 24 therein, delivers the cooled exhaust gas through the low pressure branch of the EGR conduit 52A or the high pressure branch of the EGR conduit 52B as is determined by the controller 58 operating on the first and second EGR valves 54 and 62. In this configuration, the low pressure diverted exhaust gas 56 that is delivered to the intake system 12, downstream of the throttle 19, is also subjected to cooling by the exhaust gas cooler 66 prior to its delivery thereto.

Figure 3:
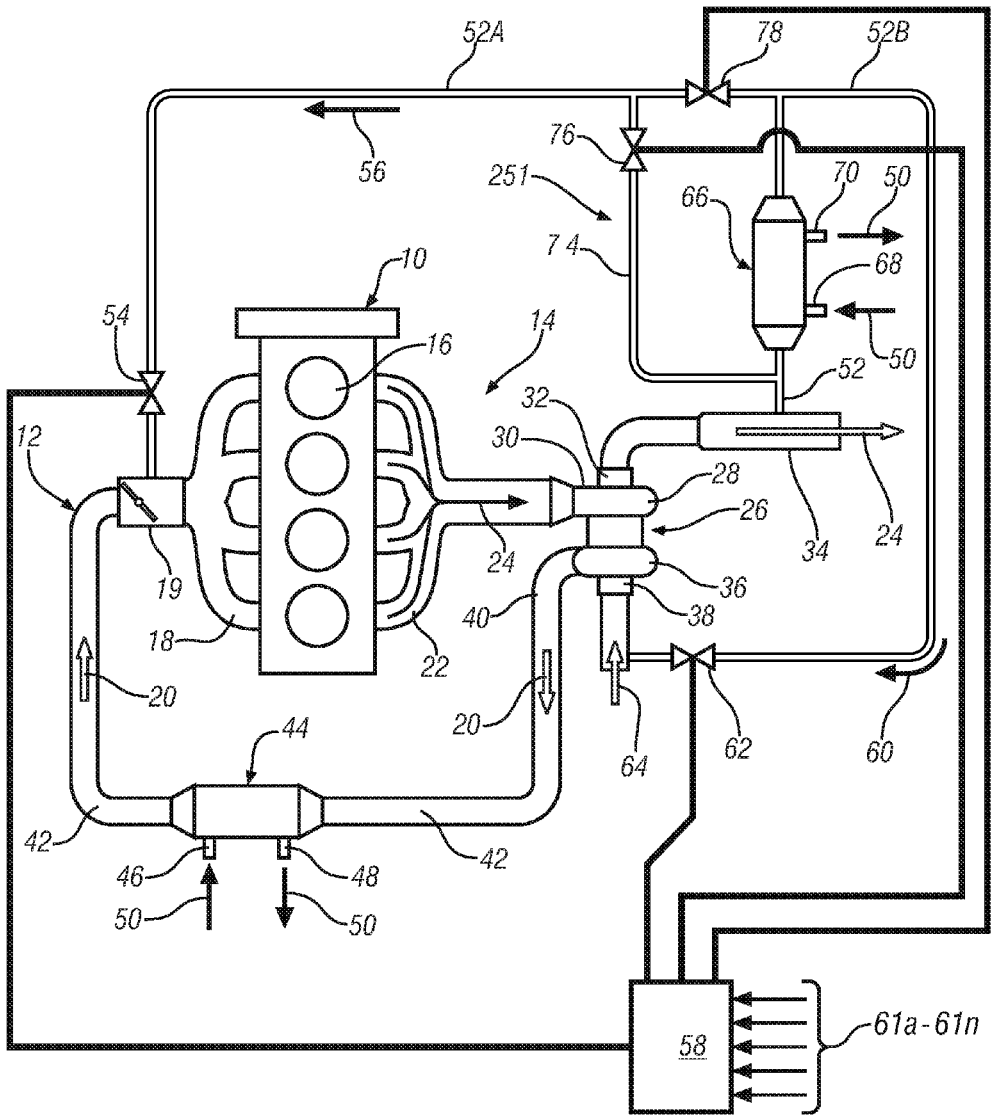
FIG. 3 is a schematic view of an internal combustion engine system comprising yet another embodiment of the exhaust gas recirculation system and the intake air charge system of FIG. 1, embodying features of the present invention.

Referring now to FIG. 3, in another exemplary embodiment, in which like reference numerals refer to like features already described, the exhaust gas recirculation ("EGR") system 251 includes an EGR conduit 52 in fluid communication with the exhaust gas conduit 34 for receipt of exhaust gas 24 therefrom. The EGR conduit 52 is located on the downstream, low pressure side of the exhaust driven turbocharger 26, and is configured to divert a portion of the exhaust gas 24 from the exhaust gas conduit 34 and to return it to, or recirculate it to the intake system 12. Disposed inline of the EGR conduit 52, is an exhaust gas cooler 66 comprising an inlet 68 and an outlet 70 for the circulation of cooling medium 50 therethrough. The exhaust gas cooler 66 receives exhaust gas 24 from the EGR conduit 52 and, following cooling of the diverted exhaust gas therein, delivers the cooled, exhaust gas 24 through the low pressure branch of the EGR conduit 52A or the high pressure branch of the EGR conduit 52B. The controller 58 operating on the first and second EGR valves 54 and 62 determines the delivery path of the exhaust gas 24. In this configuration, the diverted exhaust gas 56 that is delivered to the intake system 12, downstream of the throttle 19, is also subjected to cooling by the exhaust gas cooler 66 prior to its delivery thereto. In the exemplary embodiment shown in FIG. 3, an exhaust gas diverter branch 74 is in fluid communication with the EGR conduit 52 upstream of the exhaust gas cooler 66 and extends to a location downstream of the exhaust gas cooler where it is in fluid communication with low pressure EGR conduit branch 52A, high pressure EGR conduit branch 52 B, or both.

An exhaust bypass valve 76 is located in fluid communication with the exhaust gas diverter branch 74 and is configured to allow exhaust gas 24 to bypass the exhaust gas cooler 66, should cooling of the exhaust gas be deemed undesirable by the controller 58 based on the various inputs 61*a* through 61*n*. Controller 58 is in signal communication with exhaust bypass valve 76 and, upon determination that cooling of the diverted exhaust gas 56 is undesirable, may operate the exhaust bypass valve to allow diverted exhaust gas 56 to flow, un-cooled through the exhaust gas diverter branch 74. A second exhaust gas valve 78 is disposed between the low pressure EGR conduit branch 52A and the high pressure EGR conduit branch 52 B. The controller 58 is also in signal communication with the second exhaust gas valve 78 and is operable to close the valve when un-cooled diverted exhaust gas 56 is shunted past the exhaust gas cooler 66. This closing operation prevents the un-cooled diverted exhaust gas 56 from entering the high pressure EGR conduit branch 52B when un-cooled diverted exhaust gas 56 is being directed to the intake system 12 downstream of the throttle body 19.

The exemplary embodiments described provide for the addition of diverted exhaust gas 56 to the intake system 12 of the internal combustion engine 10, downstream of the throttle 19 which operates to supplement the EGR system by providing adequate diverted exhaust gas flow to the engine cylinders 16 under low speed and light load conditions thereby improving the fuel economy benefits of sufficient EGR. The distance between the introduction of the diverted exhaust gas 56 to the engine cylinders 16 is significantly shortened in such an arrangement resulting in an increase in transient EGR response. Also, bypassing the exhaust driven turbocharger 26 (i.e. directing diverted exhaust gas 56 directly to the intake system 12 during low-load operation) reduces the opportunity for the contamination of the turbocharger compressor by exhaust gas 24. The various embodiments provide for flexibility in selecting between cooled and un-cooled exhaust gas for part-load operation of the internal combustion engine 10. Also, as indicated, withdrawing exhaust gas for the purpose of recirculating exhaust gas to the engine 10 downstream of the exhaust driven turbocharger 26 results in improved performance of the turbocharger 26.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. An exhaust gas recirculation system in fluid communication with an intake system of an internal combustion engine comprising:

an exhaust system having an exhaust manifold in fluid communication with cylinders of the internal combustion engine and configured to remove exhaust therefrom, the exhaust manifold having a single exhaust outlet;

an exhaust gas driven turbocharger having a turbine housing including a high pressure turbine inlet in fluid communication with the exhaust manifold and configured to receive exhaust gas from the single exhaust of the exhaust manifold, a low pressure turbine outlet in fluid communication with an exhaust gas conduit of the exhaust system for discharge of exhaust gas from the turbine housing and a compressor housing having a low pressure compressor inlet in communication with ambient and a high pressure compressor outlet in communication with the intake system;

an exhaust gas recirculation conduit in fluid communication with the exhaust gas conduit and configured to divert a portion of exhaust gas therefrom;

a low pressure exhaust gas recirculation branch extending between and fluidly connecting the exhaust gas recirculation conduit and the intake system to deliver uncompressed exhaust gas thereto; and a high pressure exhaust gas recirculation branch extending between and fluidly connecting the exhaust gas recirculation conduit and the low pressure compressor inlet of the exhaust gas driven turbocharger and configured to deliver exhaust gas to the low pressure compressor inlet for compression in said exhaust gas driven turbocharger and delivery to the intake system.

2. The exhaust gas recirculation system of claim 1, further comprising:

a first exhaust gas recirculation valve disposed in the low pressure exhaust gas recirculation branch and configured to adjust a volumetric quantity of exhaust gas delivered to the intake system; and a second exhaust gas recirculation valve disposed in the high pressure exhaust gas recirculation branch and configured to adjust a volumetric quantity of exhaust gas to be delivered to the compressor housing for compression therein and delivery to the intake system.

3. The exhaust gas recirculation system of claim 2, further comprising: a controller in signal communication with the internal combustion engine and the first and second exhaust gas recirculation valves and configured to operate the valves to adjust the volumetric quantity of exhaust gas flowing therethrough.

4. The exhaust gas recirculation system of claim 1, further comprising:

an exhaust gas cooler in fluid communication with the high pressure exhaust gas recirculation branch.

5. The exhaust gas recirculation system of claim 1, further comprising:

an intake charge cooler in fluid communication with the intake system of the internal combustion engine.

6. The exhaust gas recirculation system of claim 1, further comprising:

an exhaust gas cooler in fluid communication with the exhaust gas recirculation conduit and located upstream of the low pressure exhaust gas recirculation branch and the high pressure exhaust gas recirculation branch.

7. The exhaust gas recirculation system of claim 6, further comprising:

an exhaust gas diverter branch in fluid communication with the exhaust gas recirculation conduit at a location upstream of the exhaust gas cooler and extending to, and in fluid communication with the low pressure exhaust gas recirculation branch; and a bypass valve disposed in the exhaust gas diverter branch and configured to divert high temperature, un-cooled exhaust gas from the exhaust gas recirculation conduit and to the low pressure exhaust gas recirculation branch.

8. The exhaust gas recirculation system of claim 7, further comprising:

a controller in signal communication with the internal combustion engine and the bypass valve and configured to operate the valve to vary a temperature of exhaust gas flowing to the low pressure exhaust gas recirculation branch and the intake system of the internal combustion engine.

9. An internal combustion engine comprising:

an intake system having an intake manifold in fluid communication with cylinders of the internal combustion engine and configured to deliver an intake charge thereto;

a throttle in fluid communication with the intake manifold and configured to receive the intake air charge from an intake air conduit for delivery to the intake manifold;

an exhaust system having exhaust manifold in fluid communication with the cylinders of the internal combustion engine and configured to remove exhaust gas therefrom, the exhaust manifold having a single exhaust outlet;

an exhaust gas driven turbocharger including a high pressure turbine inlet in fluid communication with the exhaust manifold, a low pressure turbine outlet in fluid communication with an exhaust gas conduit of the exhaust system and a compressor housing including a low pressure compressor inlet in communication with ambient and a high pressure compressor outlet in communication with the intake air conduit;

an exhaust gas recirculation conduit in fluid communication with the exhaust gas conduit;

a low pressure exhaust gas recirculation branch extending between the exhaust gas recirculation conduit and the intake system at a position downstream of the throttle; and a high pressure exhaust gas recirculation branch extending between the exhaust gas recirculation conduit and the low pressure compressor inlet of the exhaust gas driven turbocharger.

10. The internal combustion engine of claim 9, further comprising:

a first exhaust gas recirculation valve disposed in the low pressure exhaust gas recirculation branch; and a second exhaust gas recirculation valve disposed in the high pressure exhaust gas recirculation branch.

11. The internal combustion engine of claim 10, further comprising:

a controller in signal communication with the internal combustion engine and the first and second exhaust gas recirculation valves and configured to operate the valves to vary a volumetric quantity of exhaust gas flowing therethrough.

12. The internal combustion engine of claim 9, further comprising:

an exhaust gas cooler in fluid communication with the high pressure exhaust gas recirculation branch.

13. The internal combustion engine of claim 9, further comprising an intake charge cooler in fluid communication with the intake air conduit.

14. The internal combustion engine of claim 9, further comprising:

an exhaust gas cooler in fluid communication with the exhaust gas recirculation conduit and located upstream of the low pressure exhaust gas recirculation branch and the high pressure exhaust gas recirculation branch.

15. The internal combustion engine of claim 14, further comprising:

an exhaust gas diverter branch in fluid communication with the exhaust gas recirculation conduit at a location upstream of the exhaust gas cooler and extending to, and in fluid communication with the low pressure exhaust gas recirculation branch; and a bypass valve disposed in the exhaust gas diverter branch and operable to divert high temperature, un-cooled exhaust gas from the exhaust gas recirculation conduit and to the low pressure exhaust gas recirculation branch.

16. The internal combustion engine of claim 15, further comprising:

a controller in signal communication with the internal combustion engine and the bypass valve and configured to operate the valve to vary a temperature of exhaust gas flowing to the low pressure exhaust gas recirculation branch and the intake system of the internal combustion engine.

* * * * *